US007323824B2

(12) United States Patent
Brates et al.

(10) Patent No.: US 7,323,824 B2
(45) Date of Patent: Jan. 29, 2008

(54) METHODS AND APPARATUS FOR OPERATING VERY HIGH PRESSURE SHORT ARC DISCHARGE LAMPS

(75) Inventors: Nanu Brates, Winchester, MA (US); Jakob Maya, Brookline, MA (US)

(73) Assignee: Matsushita Electric Works Ltd., Osaka (JP)

( * ) Notice: Subject to any disclaimer, the term of this patent is extended or adjusted under 35 U.S.C. 154(b) by 0 days.

(21) Appl. No.: 10/910,387

(22) Filed: Aug. 3, 2004

(65) Prior Publication Data

US 2006/0028149 A1 Feb. 9, 2006

(51) Int. Cl.
*H05B 37/02* (2006.01)

(52) U.S. Cl. ..... 315/224; 315/307; 315/DIG. 5

(58) Field of Classification Search ..... 315/307, 315/224, DIG. 5
See application file for complete search history.

(56) References Cited

U.S. PATENT DOCUMENTS 5,572,094 A * 11/1996 Yamashita et al. ..... 315/308
5,608,294 A 3/1997 Derra et al.
6,153,987 A * 11/2000 Toda et al. ..... 315/308
6,232,725 B1 5/2001 Derra et al.
6,239,556 B1 5/2001 Derra et al.

FOREIGN PATENT DOCUMENTS

WO WO 2004/002200 A1 12/2003

* cited by examiner

*Primary Examiner*—David H. Vu
(74) *Attorney, Agent, or Firm*—Wolf Greenfield & Sacks P.C.

(57) ABSTRACT

Methods and apparatus are provided for operating very high pressure short arc mercury discharge lamps primarily used for projection applications. The method includes controlling an alternating lamp current supplied to the lamp at a constant RMS value. In some embodiments, the lamp current is adjusted to a new constant RMS value to maintain lamp power between an upper power limit and a lower power limit. In other embodiments, lamp cooling is adjusted to maintain a wall temperature of the arc tube below a softening temperature.

33 Claims, 13 Drawing Sheets

METHODS AND APPARATUS FOR OPERATING VERY HIGH PRESSURE SHORT ARC DISCHARGE LAMPS

FIELD OF THE INVENTION

This invention relates to arc discharge lamps and, more particularly, to methods and apparatus for operating very high pressure short arc mercury discharge lamps primarily used for projection applications.

BACKGROUND OF THE INVENTION

Very high pressure discharge lamps include an arc tube containing an inert gas, mercury vapor, and two electrodes positioned at opposite ends of the arc tube. An arc discharge is established in the arc tube by supplying an electrical current to the electrodes. The very high pressure discharge lamp is typically utilized for projection applications, where the optical system requires point-like light sources. To achieve such optical performance, the arc length must be on the order of 1.0-1.5 millimeters. The lamps typically include an arc tube constructed of heat resistant and optical transparent material such as quartz, tungsten electrodes, mercury vapor and an inert starting gas. The electrodes are constructed of a tungsten rod with a tungsten coil attached to one end.

Typically, the electrode tip in very high pressure discharge lamps reaches temperatures close to or even above the melting point of tungsten. This is necessary to prevent movement of the point of arc attachment to the electrode, also called the arc root. However, if the electrodes become too cold, the molten tip solidifies and collapses to a relatively flat surface. The arc attachment becomes unstable, leading to sudden arc movement or jumping. Moreover, the distance between electrodes increases, thereby reducing the performance of the light collecting optics. On the other hand, if the electrodes become too hot, the molten region increases, leading to a meltback condition where the distance between electrodes increases, thereby reducing the performance of the light collecting optics. Moreover, during the meltback, increased amounts of tungsten are evaporated from the electrodes and deposited on the arc tube walls, leading to poor lamp maintenance. Therefore, the operation of very high pressure discharge lamps needs to be optimized in order to achieve the most beneficial electrode temperature.

A problem in establishing the optimal temperature for the two electrodes of a discharge lamp may arise when the lamp current is varied. Such a situation occurs as the lamp voltage increases. To maintain constant power conditions, prior arc ballast circuitry reduces the lamp current. As a result, the tip temperature of one electrode is reduced such that the tip starts to solidify. Upon solidification, the tip of the electrode diminishes, leading to a larger arc gap and therefore, a larger lamp voltage. The current supply to the lamp decreases and the electrode tip temperature is further reduced. The process continues until the electrode surface becomes flat. Arc instability may then occur.

Furthermore, a very high pressure discharge lamp is usually mounted in a reflector, which changes the thermal environment of the arc tube. One end of the lamp, and thus one electrode, may be hotter than the other end. In typical applications, very high pressure discharge lamps are operated with forced air cooling, which is usually directed to both sides of the lamp or to the upper side of the lamp.

Depending on the configuration of the cooling airflow, different lamp performance is achieved.

During the lifetime of a discharge lamp, the structure of the electrodes may change due to tungsten transport from the tip of the electrode. In cases where one of the electrodes has started to melt back, its ability to conduct heat from the electrode tip changes, and the flattening process may accelerate, leading to early lamp failure. Using preshaped electrodes cannot compensate for most of these asymmetries, because they are unpredictable. Different electrode shapes require additional devices to permit proper mounting of the lamp in the system in which it is employed.

Techniques and circuits for operating high pressure discharge lamps are disclosed in U.S. Pat. No. 5,608,294, issued Mar. 4, 1997 to Derra et al.; U.S. Pat. No. 6,232,725, issued May 15, 2001 to Derra et al.; U.S. Pat. No. 6,239,556, issued May 29, 2001 to Derra et al.; and International Publication No. WO 2004/002200, published Dec. 31, 2003. All of the known prior art techniques have had one or more drawbacks and disadvantages.

Accordingly, there is a need for methods and apparatus for operating very high pressure discharge lamps with improved performance and lifetime.

SUMMARY OF THE INVENTION

According to a first aspect of the invention, a method is provided for operating a high pressure discharge lamp. The method comprises controlling an alternating lamp current supplied to the lamp at a constant RMS value, and adjusting the lamp current to a new RMS value to prevent power supplied to the lamp from exceeding an upper power limit. The lamp current is maintained constant at the new RMS value.

According to a second aspect of the invention, a lamp system comprises a high pressure discharge lamp, a power circuit for supplying alternating current to the lamp, and a controller configured to control the lamp current at a constant RMS value and to adjust the lamp current to a new RMS value to prevent power supplied to the lamp from exceeding an upper power limit. The lamp current is maintained constant at the new RMS value.

According to a third aspect of the invention, a method is provided for operating a high pressure discharge lamp including an arc tube. The method comprises controlling an alternating current supplied to the lamp at a constant RMS value, and adjusting lamp cooling to maintain a wall temperature of the arc tube below a softening temperature.

According to a fourth aspect of the invention, a lamp system comprises a high pressure discharge lamp including an arc tube, a power circuit for supplying alternating current to the lamp, a cooling source directed at the lamp, and a controller configured to control the lamp current at a constant RMS value and to adjust the cooling source to maintain a wall temperature of the arc tube below a softening temperature.

According to a fifth aspect of the invention, a method is provided for operating a high pressure discharge lamp. The method comprises controlling an alternating lamp current supplied to the lamp at a constant RMS value, and adjusting the lamp current to a new RMS value to maintain lamp power between an upper power limit and a lower power limit. The lamp current is maintained constant at the new RMS value.

According to a sixth aspect of the invention, a lamp system comprises a high pressure discharge lamp, a power circuit for supplying alternating current to the lamp and a controller configured to control the lamp current at a constant RMS value and to adjust the lamp current to a new RMS value to maintain lamp power between an upper power limit and a lower power limit. The lamp current is maintained constant at the new RMS value.

According to a seventh aspect of the invention, a method is provided for operating a high pressure discharge lamp. The method comprises controlling an alternating lamp current supplied to the lamp at a constant RMS value; and increasing the lamp current to a new RMS value in response to a prescribed value of lamp voltage and maintaining the lamp current constant at the new RMS value.

According to an eighth aspect of the invention, a lamp system comprises a high pressure discharge lamp; a power circuit for supplying alternating lamp current to the lamp; and a controller configured to control the lamp current at a constant RMS value, to increase the lamp current to a new RMS value in response to a prescribed value of lamp voltage and to maintain the lamp current constant at the new RMS value.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
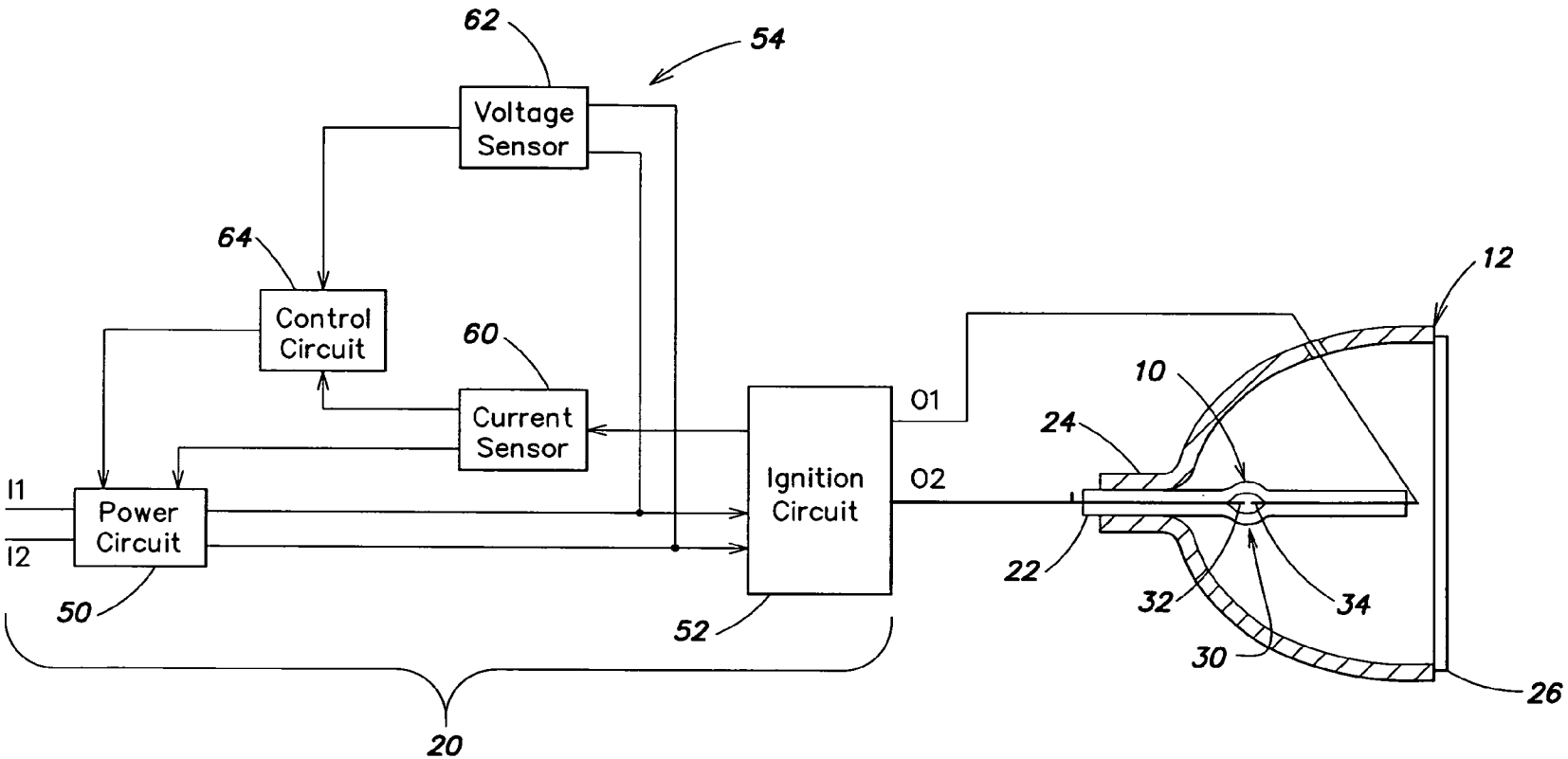
FIG. 1 is a schematic block diagram of a lamp system in accordance with a first embodiment of the invention.

A schematic block diagram of a lamp system in accordance with a first embodiment of the invention is shown in FIG. 1. The lamp system includes a very high pressure discharge lamp 10 and an electronic power supply 20. Discharge lamp 10 is mounted in a reflector 12. One end 22 of discharge lamp 10 is secured in a neck 24 of reflector 12. The reflector 12 is enclosed by a transparent member 26.

Very high pressure discharge lamps typically include an arc tube 30 constructed of a heat resistant and optically transparent material, such as quartz. Tungsten electrodes 32 and 34 are mounted at opposite ends of arc tube 30, and the interior volume of arc tube 30 contains mercury vapor and an inert starting gas. Each of electrodes 32 and 34 includes a tungsten rod 40 having a tungsten coil 42 attached to one end, as shown schematically in FIGS. 2 and 3. Electrodes 32 and 34 are separated by an electrode distance, called the arc length. To achieve a desired optical performance, the arc length is on the order of 1.0-1.5 millimeters. The electrodes are affixed to opposite ends of arc tube 30 by press pinching. The electrodes are connected by appropriate electrical wiring to respective output terminals O1 and O2 of electronic power supply 20.

Electronic power supply 20 includes a power circuit 50, an ignition circuit 52 and a controller 54. When input terminals I1 and I2 of electronic power supply 20 are connected to an AC voltage supply, power circuit 50 generates an alternating current having successive periods of alternate polarity and of predetermined shape. By way of example, the alternating current may be a square wave. However, the alternating current is not limited as to wave shape. Ignition circuit 52 ensures lamp starting.

Controller 54 senses the operation of discharge lamp 10 and controls lamp current in accordance with embodiments of the invention. The controller 54 includes a lamp current sensor 60, a lamp voltage sensor 62 and a control circuit 64. Lamp current sensor 60 senses a lamp current value and provides outputs to power circuit 50 and control circuit 64. Lamp voltage sensor 62 senses a lamp voltage value at the output of power circuit 50 and provides a voltage value to control circuit 64. Control circuit 64 controls power circuit 50 in this embodiment. Control circuit 64 computes lamp power and maintains lamp power within specified limits as described below. Power circuit 50 maintains a constant value of RMS lamp current, with changes to new constant values of RMS lamp current in response to changes in lamp operation. The lamp current is an alternating current, having successive periods of alternate polarity and of predetermined shape. The RMS (root mean square) value of the alternating current is maintained constant over extended periods of time, its value depending on lamp operation as described below.

Figure 2:
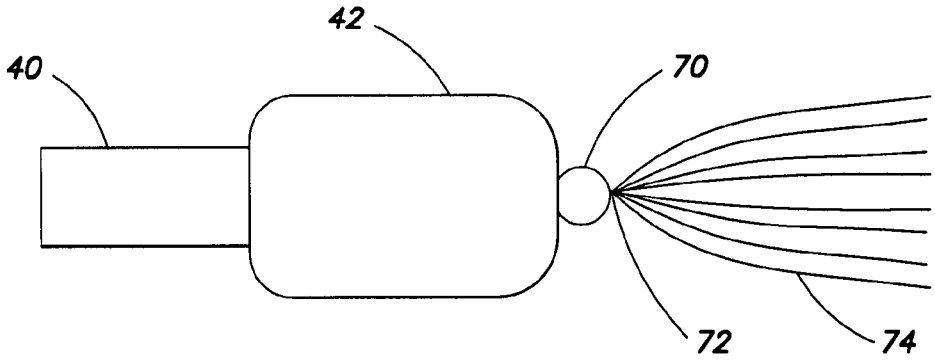
FIG. 2 illustrates an electrode condition for stable arc root attachment.
Figure 3:
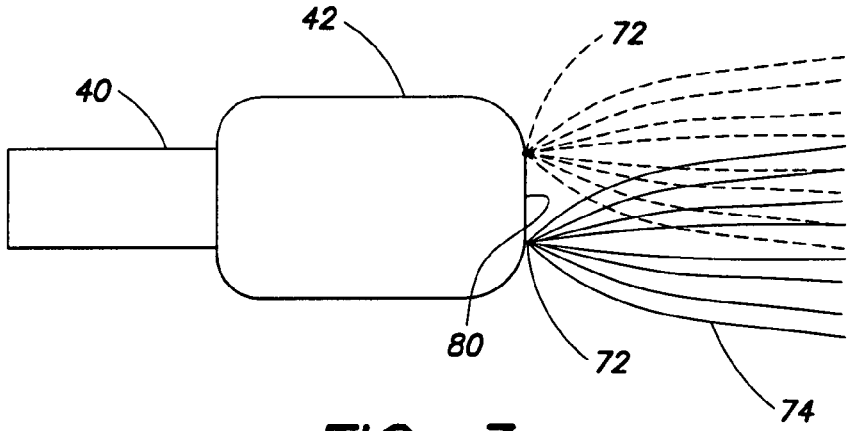
FIG. 3 illustrates a flat electrode tip which exhibits flicker conditions.

When discharge lamp 10 is energized, the tips of electrodes 32 and 34 typically reach temperatures close to or even above the melting point of tungsten. Such operating temperatures are necessary to prevent movement of the point of arc attachment to the electrode, also called the arc root. As shown in FIG. 2, when the electrode has a rounded tip 70, the arc root 72 of arc 74 remains at a fixed position. However, if the electrode temperature becomes too low, the molten tip solidifies and collapses to a relatively flat surface 80 as shown in FIG. 3. Then, arc root 72 may move on flat surface 80, causing the lamp to flicker. Unexpectedly, it was discovered that by maintaining a controlled constant RMS value of lamp current $I_{lmp}$, it is possible to substantially preserve the round shape of the electrode tip over an extended period of time, regardless of lamp voltage changes.

Figure 4:
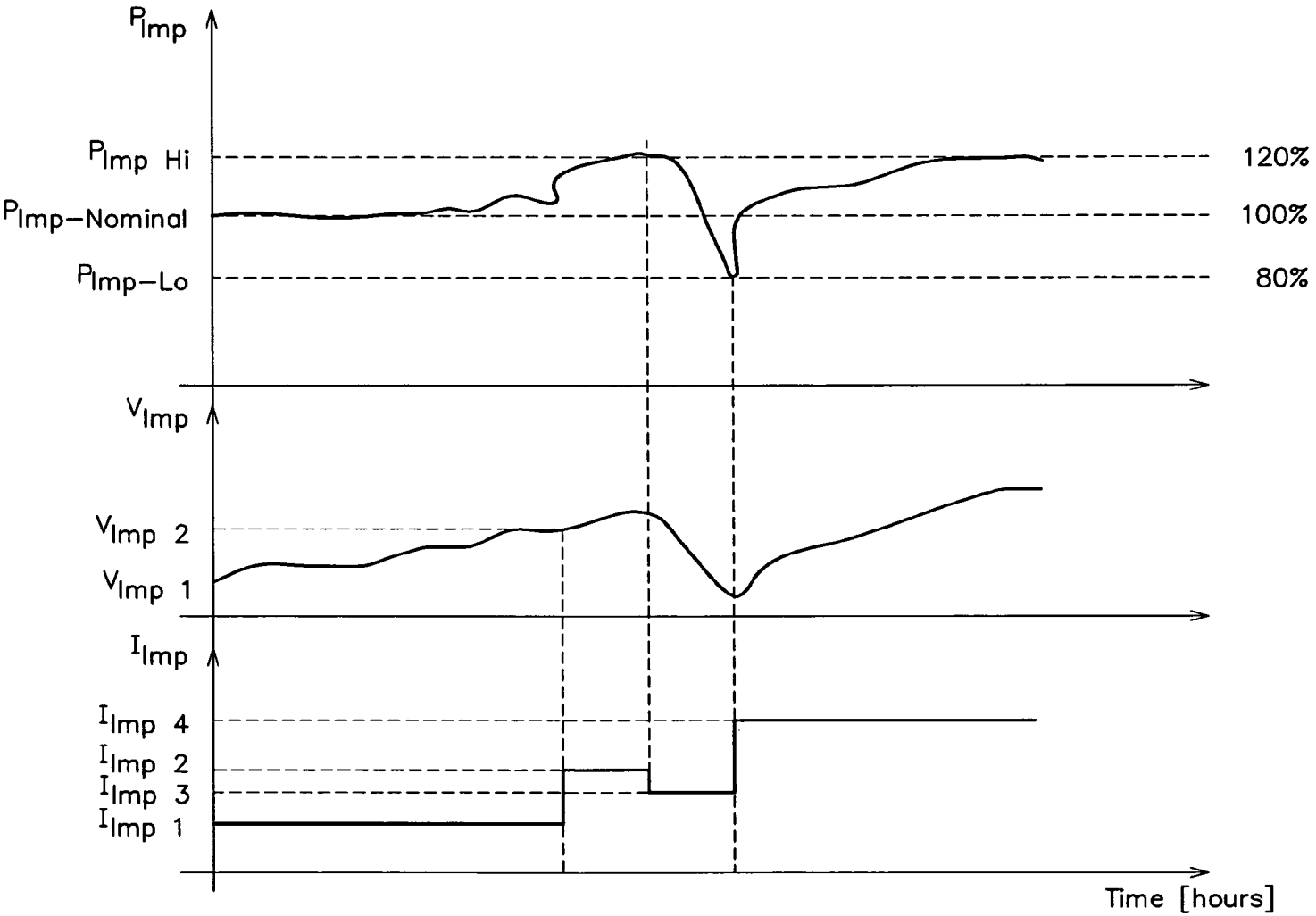
FIG. 4 is a graph of lamp power, lamp voltage and lamp current as a function of time and illustrates current control in accordance with embodiments of the invention.

FIG. 4 illustrates a lamp control routine in accordance with embodiments of the invention. Lamp power $P_{lmp}$, lamp voltage $V_{lmp}$ and lamp current $I_{lmp}$ are plotted as a function of time in FIG. 4. Initially, it is assumed that lamp power, lamp voltage and lamp current are at nominal values. In this case, the lamp current $I_{lmp}$ is controlled at a constant RMS value $I_{lmp1}$. In response to lamp changes, the lamp RMS current can be changed to a new constant RMS value. When the lamp voltage increases to a prescribed value of $V_{lmp2}$, the lamp current is increased to a level $I_{lmp2}$ and is maintained at a constant RMS value of $I_{lmp2}$ until a further change in lamp conditions. This routine ensures the electrode tips are maintained in a molten state with a rounded tip. In discharge lamps of this type, lamp voltage and electrode spacing increase with time. By increasing the RMS current when the lamp voltage increases to the prescribed value of $V_{lmp2}$, the voltage increase process may be slowed down or reversed. The prescribed value of $V_{lmp2}$ at which the RMS current is increased may be defined by equation (1) below, but is not limited to this value.

$$V_{lmp2} \cong V_{lmp\ nom} \cdot {}^{1}/_{2} \cdot [P_{lmp\ hi}/P_{lmp\ nom}] \quad (1)$$

where $V_{lmp\ nom}$=nominal lamp voltage, $P_{lmp\ hi}$=upper power limit, typically 120% of rated lamp power, and $P_{lmp\ nom}$=nominal lamp power.

Figure 5:
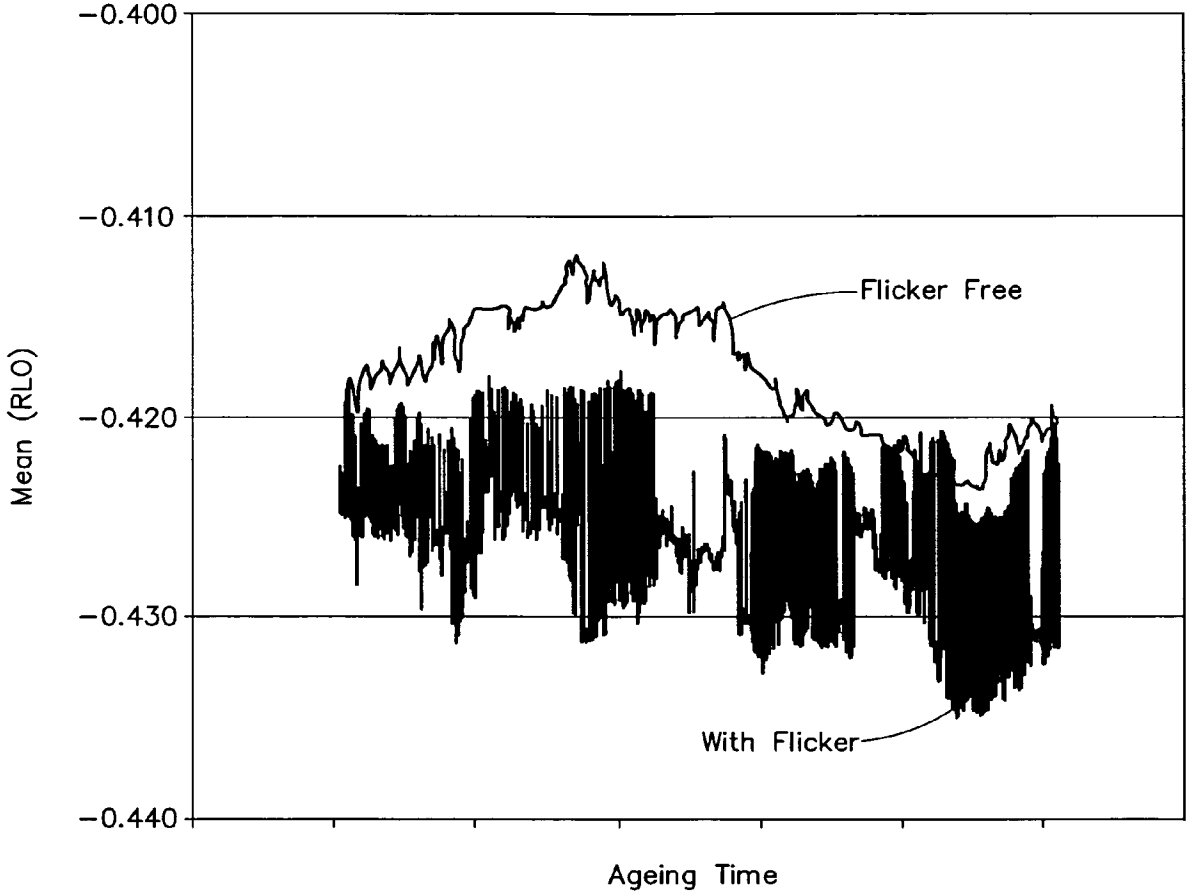
FIG. 5 is a graph of relative light output (RLO) of a discharge lamp as a function of time for flicker and flicker-free operation.

When the discharge lamp is operated with a conventional constant power ballast, the electrical power supplied to the lamp is substantially the product of the RMS values of lamp voltage and lamp current. As the lamp RMS voltage increases, the lamp RMS current is decreased proportionally to maintain the lamp power constant. Consequently, the electrode tip temperature decreases and the molten tip region starts to solidify and contract. The electrode surface becomes flat and the arc root attachment becomes unstable, leading to lamp flicker. The flicker and flicker-free modes of lamp operation may be assessed by measuring lamp relative light output (RLO). A photodiode positioned in front of the lamp reflector was utilized to quantify the light output. Typical signal traces are illustrated in FIG. 5. Large fluctuations of the RLO are indicative of arc jumping or flicker.

In another embodiment of the lamp control routine shown in FIG. 4, if the lamp power increases to an upper power limit $P_{lmp\ hi}$, typically 180 watts for 150 watts nominal lamp power or 120% of the rated lamp power, lamp current is decreased to a new constant RMS level $I_{lmp3}$, such that the lamp power does not exceed the upper power limit for the lamp. The upper power limit $P_{lmp\ hi}$ may be specified relative to the rated lamp power. Thus, in the above example an upper power limit of 180 watts is 120% of the rated lamp power or 30 watts above the rated lamp power.

In a further embodiment of the lamp control routine as shown in FIG. 4, if the lamp power decreases to a lower power limit $P_{lmp\ lo}$, typically 120 watts for 150 watts nominal lamp power or 80% of the rated lamp power, lamp current is increased to a new constant RMS level $I_{lmp4}$ so that the lamp power does not decrease below the lower power limit for the lamp.

The reaction of the discharge lamp to changes in RMS current is typically relatively slow. Thus, control circuit 64 preferably implements a delay following a change in RMS current before another change in RMS current can occur. The delay permits the discharge lamp to stabilize in response to the new operating conditions. The delay may be on the order of 25 to 50 hours, for example.

Figure 4A:
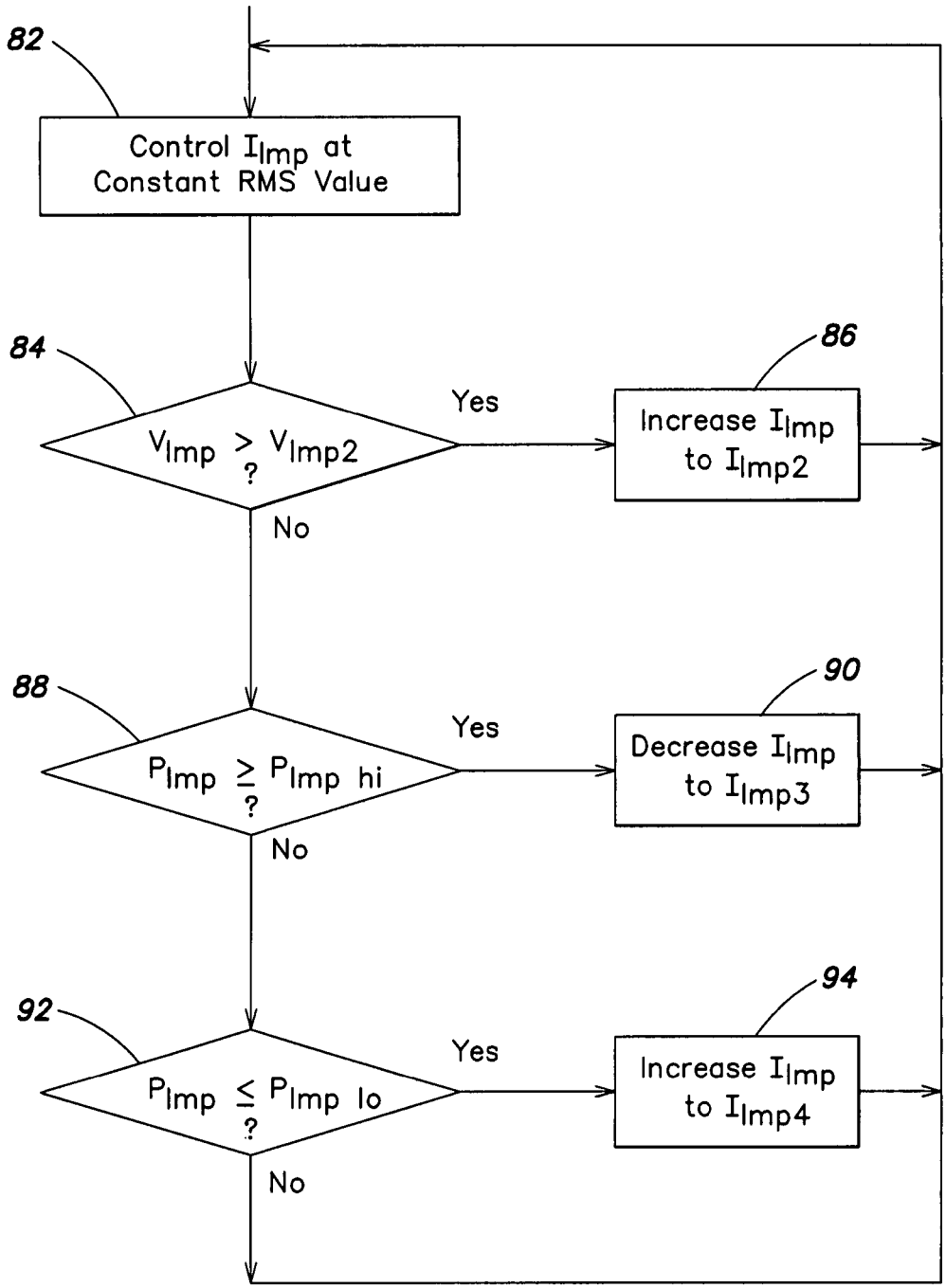
FIG. 4A is a flow chart of a process for lamp control in accordance with embodiments of the invention.

A flow chart of a control process implemented by controller 54 in the embodiments of FIGS. 1 and 4 is shown in FIG. 4A. In step 82, lamp current $I_{lmp}$ is controlled at a constant RMS value. Initially, the lamp current may be controlled at a nominal value. In step 84, the lamp voltage $V_{lmp}$ is compared with a prescribed value $V_{lmp2}$, such as the value given by equation (1) above. The prescribed value $V_{lmp2}$ of lamp voltage is typically higher than the nominal lamp voltage and indicates that the electrode spacing has increased over its nominal value. If the lamp voltage $V_{lmp}$ exceeds the prescribed value $V_{lmp2}$, the lamp current $I_{lmp}$ is increased to a new RMS value $I_{lmp2}$ in step 86. The process then returns to step 82 and the lamp current $I_{lmp}$ is maintained constant at the new RMS value. As noted above, the reaction of the discharge lamp to changes in RMS current is typically relatively slow. Accordingly, the controller 54 may implement a delay on the order of 25 to 50 hours before another comparison of lamp voltage $V_{lmp}$ with the prescribed value $V_{lmp2}$.

In step 88, the lamp power $P_{lmp}$ is compared to the upper power limit $P_{lmp\text{-}hi}$. If the lamp power $P_{lmp}$ is equal to or greater than the upper power limit, the lamp current $I_{lmp}$ is decreased to lamp current $I_{lmp3}$ in step 90. The process then returns to step 82 and the lamp current is maintained constant at the new RMS value $I_{lmp3}$. In step 92, the lamp power $P_{lmp}$ is compared with the lower power limit $P_{lmp\text{-}lo}$. If the lamp power $P_{lmp}$ is less than or equal to the lower power limit, the lamp current $I_{lmp}$ is increased to a new RMS value $I_{lmp4}$ in step 94. The process then returns to step 82 and the lamp current is maintained constant at the new RMS value $I_{lmp4}$. In the case where the lamp voltage does not exceed the prescribed value $V_{lmp2}$ and the lamp power remains between the upper and lower power limits, the lamp current is maintained constant at the present RMS value in step 82.

Figure 6:
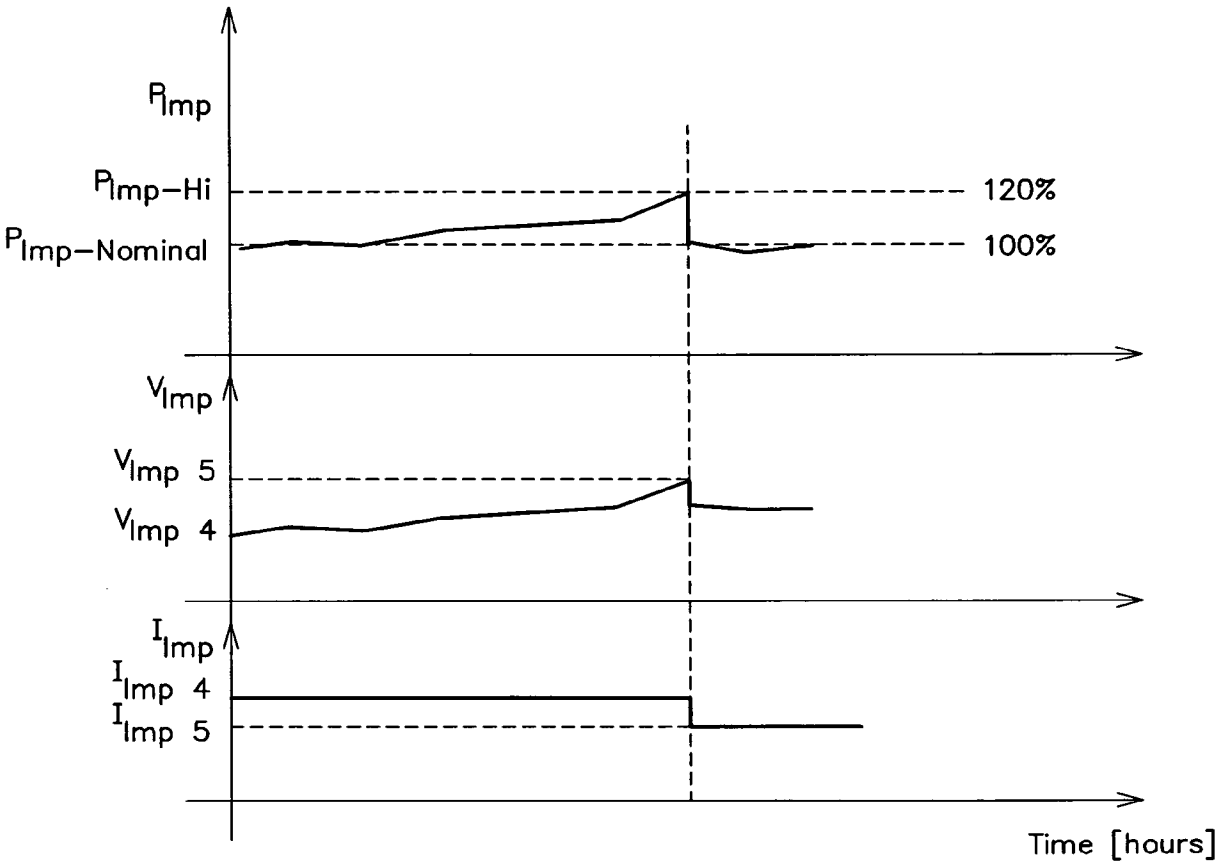
FIG. 6 is a graph of lamp power, lamp voltage and lamp current as a function of time and illustrates current control in accordance with embodiments of the invention.

A further embodiment of the lamp control routine is illustrated in FIG. 6, where lamp power, lamp voltage and lamp current are plotted as a function of time. When the lamp voltage increases to a level $V_{lmp5}$, which corresponds to the upper power limit $P_{lmp\ hi}$, typically 180 watts for 150 watts nominal lamp power or 120% of the rated lamp power, the lamp current is decreased to a new constant RMS level $I_{lmp5}$, such that the lamp operates within a desired range of the rated power.

The lamp current may be adjusted (increased or decreased) from one constant RMS value to a new constant RMS value continuously or in one or more steps. In one example, the lamp current is adjusted in increments of 1-2% of the lamp current to avoid an abrupt change in light output. Preferably, the lamp current is adjusted, based on known characteristics of the lamp, to bring the lamp power from the upper or lower power limit to or near the rated lamp power.

Figure 7:
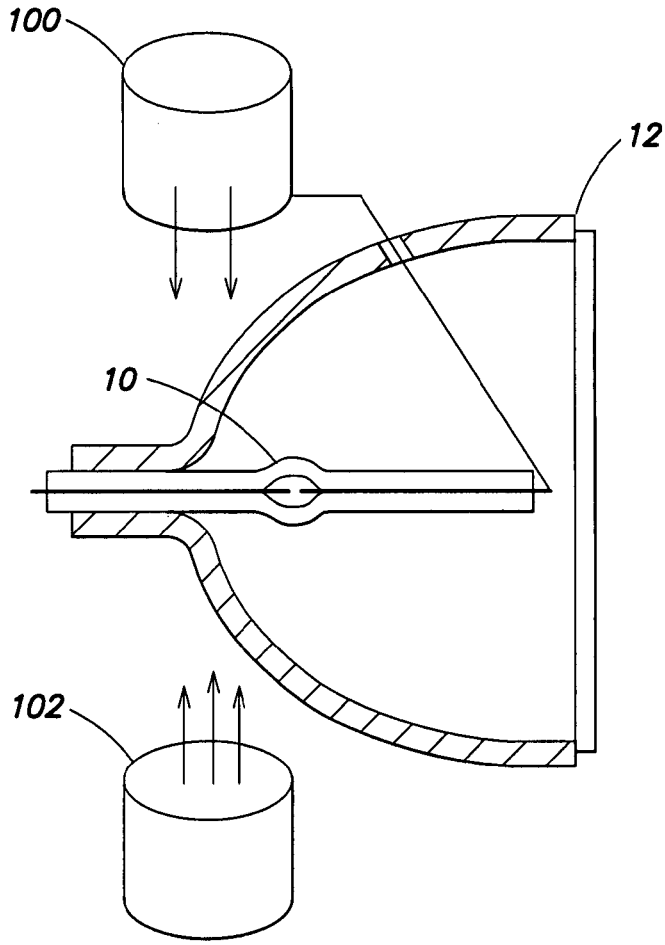
FIG. 7 is a schematic block diagram of a prior art lamp reflector and forced air cooling assembly.

Depending on operating power and projector system fixturing, very high pressure discharge lamps operate at high temperatures. Accordingly, cooling techniques are employed to extend the useful life of the lamp system. A typical prior art arrangement is shown in FIG. 7. Forced air cooling devices 100 and 102 are mounted external to reflector 12. This cooling may be directed to both sides of reflector 12 or to the upper side of reflector 12.

Figure 8:
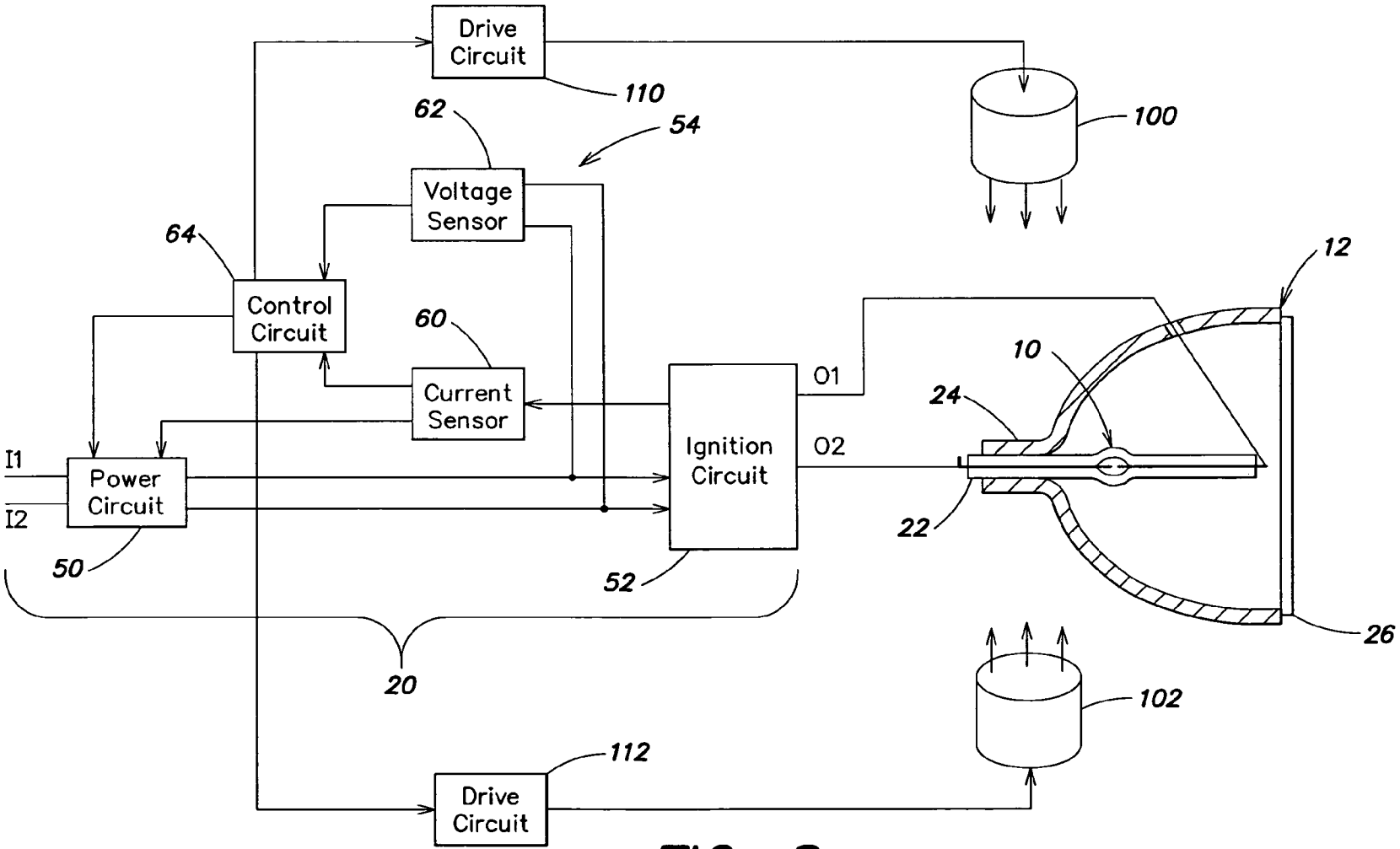
FIG. 8 is a schematic block diagram of a lamp system in accordance with a second embodiment of the invention.

A block diagram of a lamp system incorporating lamp cooling control in accordance with a further embodiment of the invention is shown in FIG. 8. Like elements in FIGS. 1 and 8 have the same reference numerals. Cooling devices 100 and 102 are controlled by drive circuits 110 and 112, respectively, which in turn are controlled by control circuit 64. The amount of controlled cooling is adjusted such that the maximum wall temperature of the arc tube 30 is maintained below the softening temperature of the arc tube material. This softening temperature is defined as the temperature at which a solid material starts losing its rigidity and starts transforming into a plastic or liquid state.

Figure 9:
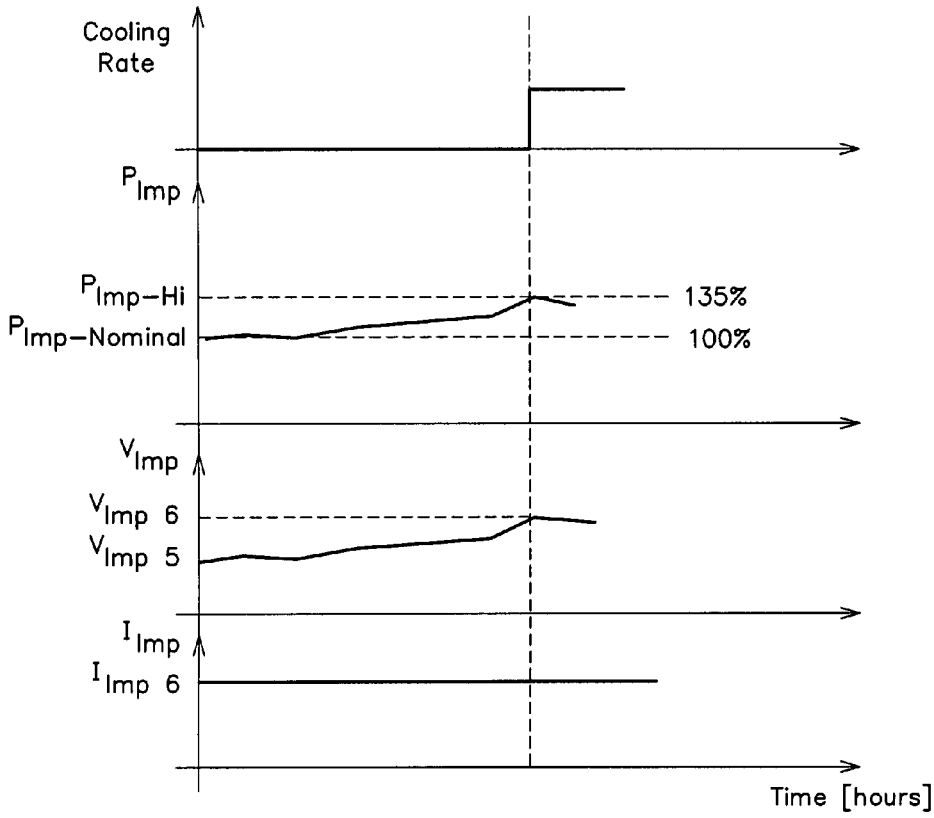
FIG. 9 is a graph of cooling rate, lamp power, lamp voltage and lamp current as a function of time and illustrates current control and cooling control in accordance with embodiments of the invention.

A lamp control routine in accordance with a further embodiment of the invention is illustrated in FIG. 9. Lamp cooling rate, lamp power, lamp voltage and lamp current are plotted as a function of time. As the lamp power increases to upper power limit $P_{lmp\ hi}$, the RMS value of lamp current is maintained constant at a level $I_{lmp6}$. To prevent overheating of the lamp and decreased lamp life, the cooling rate is increased. When the cooling rate is increased, the lamp voltage drops and the lamp power thus drops, as shown in FIG. 9.

When the material used for arc tube 30 is quartz, the critical temperature is not to exceed the devitrification point. This temperature is lower than the softening temperature and is the temperature at which quartz starts becoming opaque and loses optical transmission, typically around 1000° C.

Figure 9A:
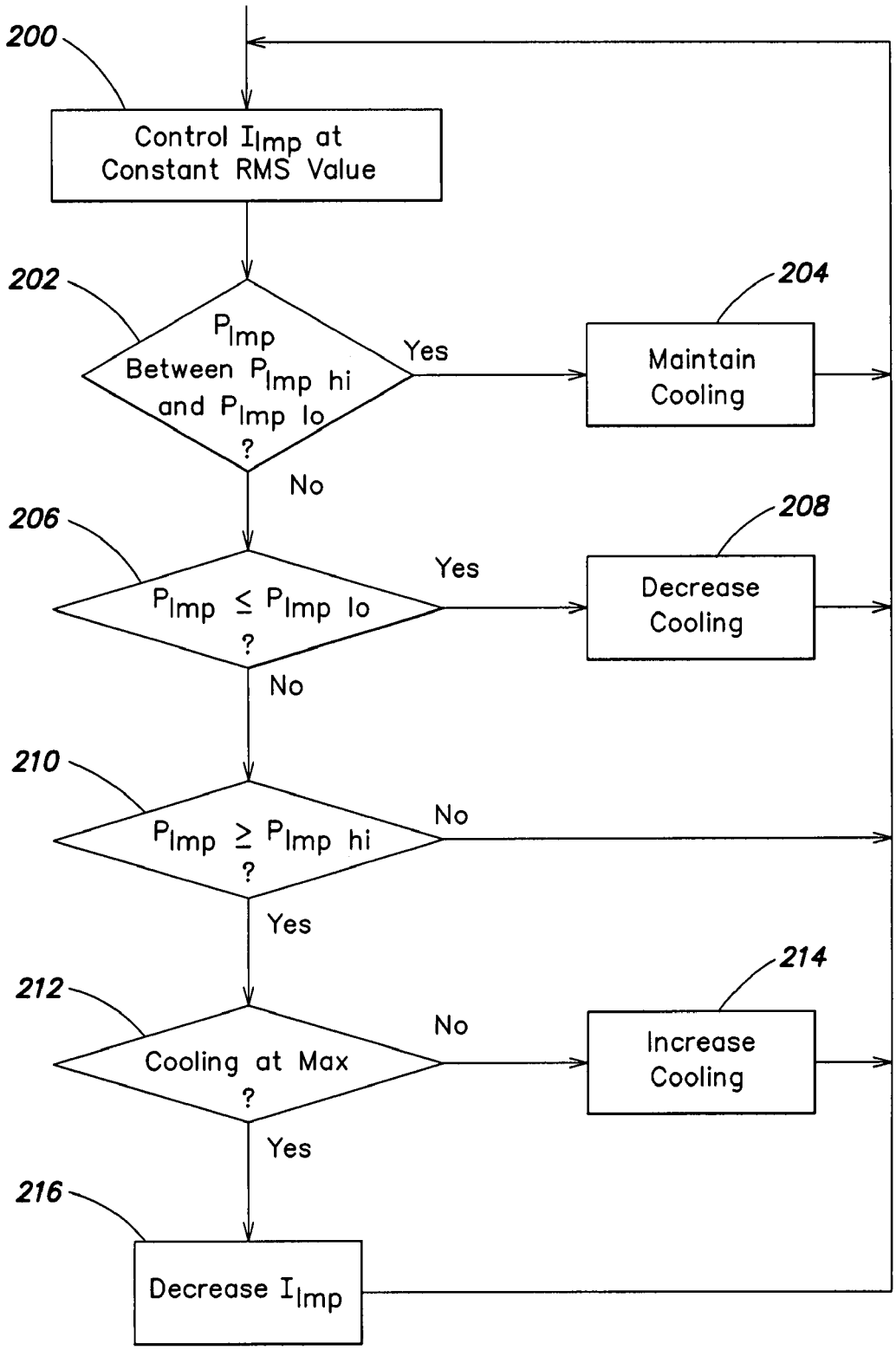
FIG. 9A is a flow chart of a process for lamp control in accordance with embodiments of the invention.

A flow chart of a lamp control process implemented by controller 54 in the embodiments of FIGS. 8 and 9 is shown in FIG. 9A. In step 200, the lamp current $I_{lmp}$ is controlled at a constant RMS value. Initially, the lamp current may be controlled at a nominal value. In step 202, the lamp power $P_{lmp}$ is compared with an upper power limit $P_{lmp\text{-}hi}$ and a lower power limit $P_{lmp\text{-}lo}$. If the lamp power is between the upper and lower power limits, lamp cooling by cooling devices 100 and 102 (FIG. 8) is maintained at its present value in step 204. If the lamp power $P_{lmp}$ is determined in step 206 to be less than or equal to the lower power limit $P_{lmp\text{-}lo}$, the lamp cooling is decreased in step 208. If the lamp power $P_{lmp}$ is determined in step 210 to be equal to or greater than the upper power limit $P_{lmp\text{-}hi}$, a determination is made in step 212 as to whether the lamp cooling is at maximum value. If the lamp cooling is not at maximum value, lamp cooling is increased in step 214, by controlling cooling devices 100 and 102. If lamp cooling is determined in step 212 to be at maximum value, the lamp current $I_{lmp}$ is decreased to a new RMS value in step 216. Following steps 204, 208, 214 and 216, the process returns to step 200 and the lamp current $I_{lmp}$ is maintained at a constant RMS value. The control process shown in FIG. 9A and described above has a relatively short time constant, since the lamp system is relatively fast to react to changes in lamp cooling and lamp current.

Figure 10:
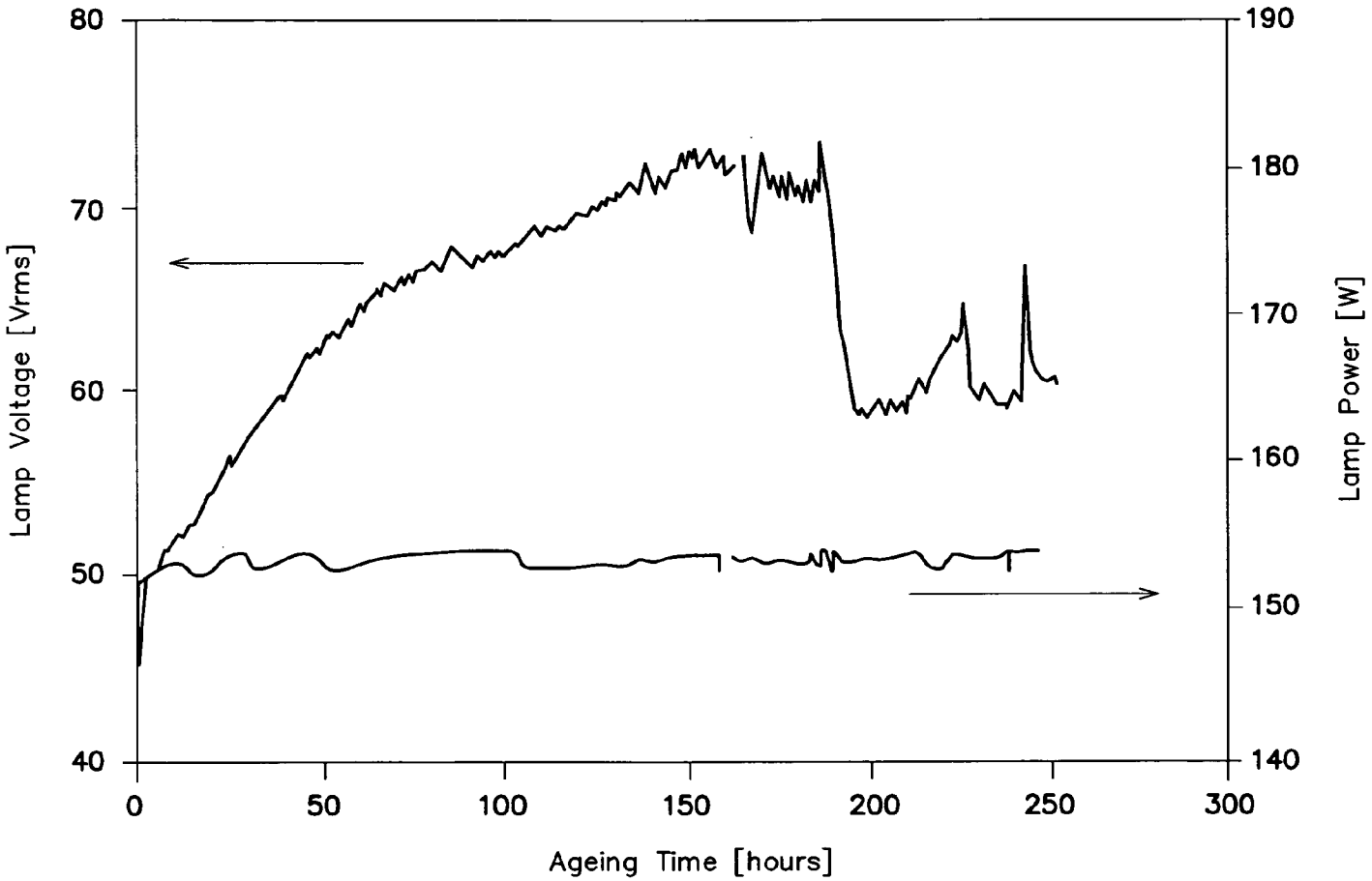
FIG. 10 is a graph of lamp voltage and lamp power as a function of time in accordance with a prior art constant power control technique.

FIG. 10 illustrates experimental graphs of the lamp voltage and lamp power versus time in accordance with the prior art technique of constant power. As the lamp voltage increases or decreases with time, lamp power is maintained constant near lamp nominal power (typically within 1-2%).

Figure 11:
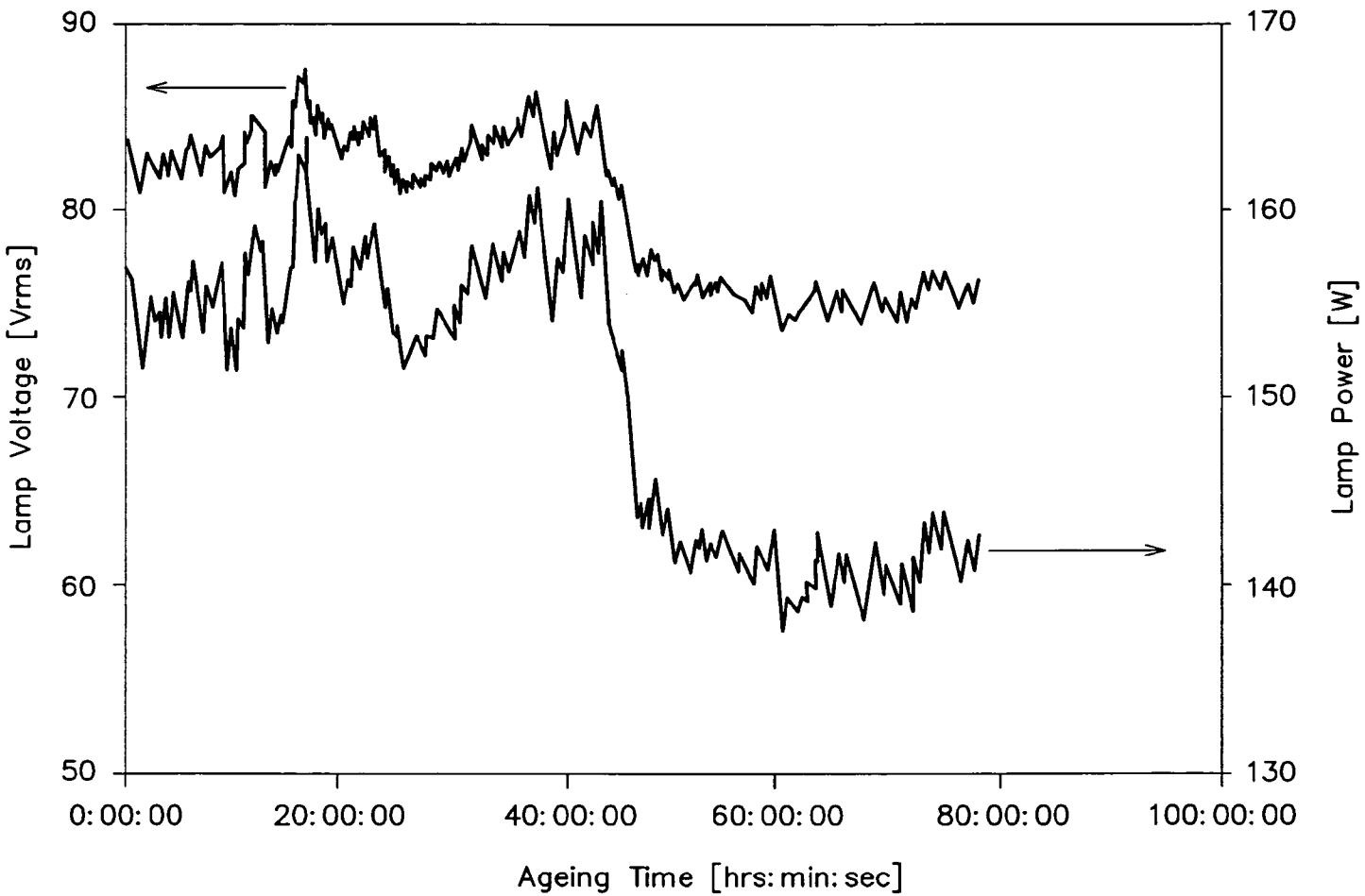
FIG. 11 is a graph of lamp voltage and lamp power as a function of time in accordance with embodiments of the invention.

FIG. 11 illustrates experimental graphs of the lamp voltage and lamp power versus time in accordance with embodiments of the invention. As the lamp voltage increases or decreases and lamp current RMS value is maintained constant and, because the electrical power supplied to the lamp is substantially the product of RMS values of lamp voltage $V_{lmp}$ and lamp current $I_{lmp}$, lamp power increases or decreases accordingly. However, lamp power is not permitted to drop below 120 W (for a 150 W nominal lamp power) or 80% of the rated lamp power.

Figure 12:
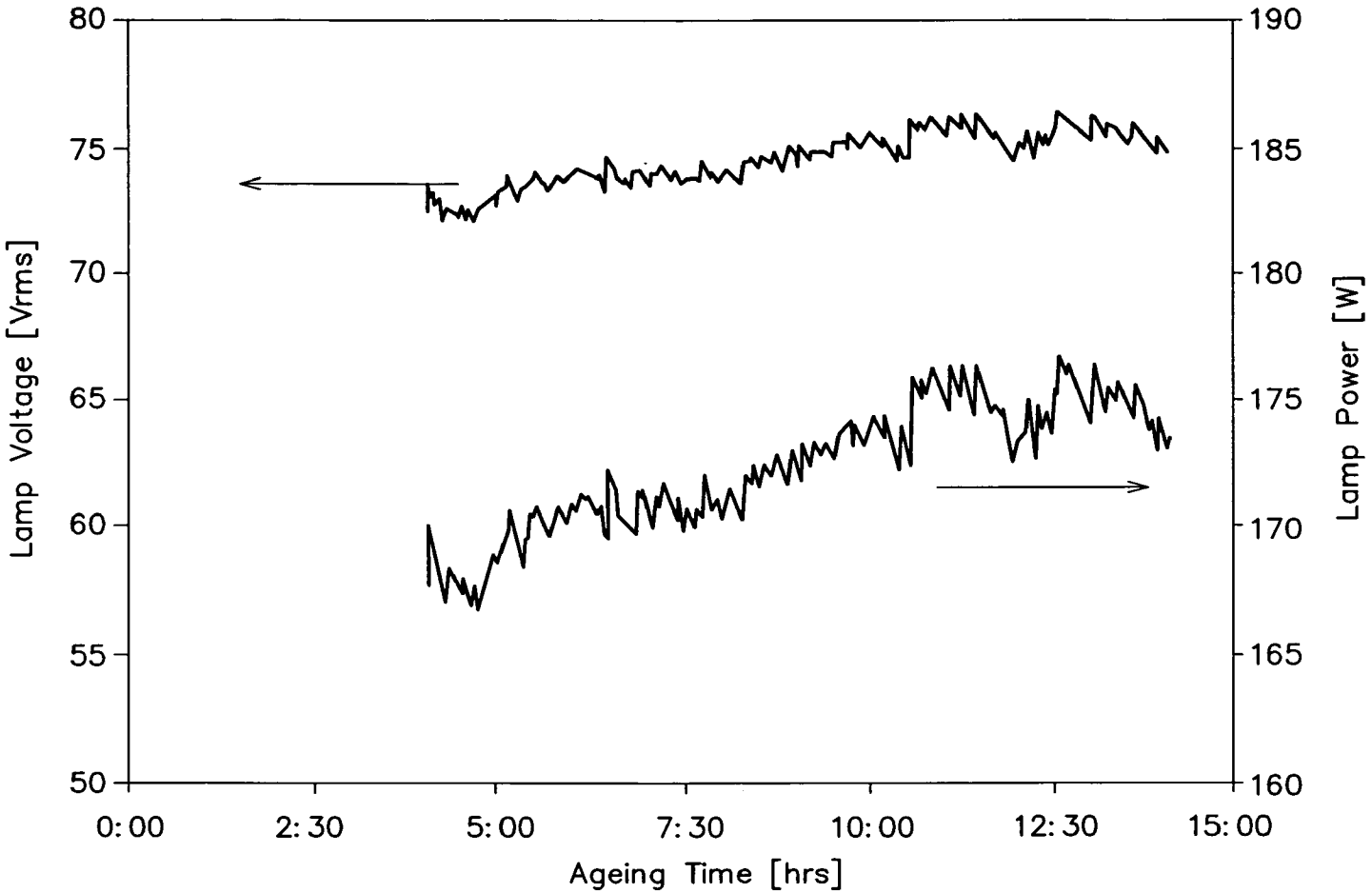
FIG. 12 is a graph of lamp voltage and lamp power as a function of time in accordance with embodiments of the invention.

FIG. 12 illustrates experimental graphs of the lamp voltage and lamp power versus time in accordance with embodiments of the invention. As the lamp voltage increases with time and lamp current RMS value is maintained constant and, because the electrical power supplied to the lamp is substantially the product of RMS values of lamp voltage $V_{lmp}$ and lamp current $I_{lmp}$, lamp power increases accordingly. However, lamp power is not permitted to exceed 180 W (for a 150 W nominal lamp power) or 120% of the rated lamp power.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A method for operating a high pressure discharge lamp, comprising:

controlling an alternating lamp current supplied to the lamp at a constant RMS value;

adjusting the lamp current to a new RMS value to prevent power supplied to the lamp from exceeding an upper power limit and maintaining the lamp current constant at the new RMS value, wherein the discharge lamp has a rated power and wherein adjusting the lamp current comprises changing the lamp current to prevent the power supplied to the lamp from exceeding a specified percentage of the rated power; and after adjusting the lamp current to a new RMS value, implementing a delay on the order of hours before again adjusting the lamp current to a new RMS value.

2. A method as defined in claim 1, wherein controlling the lamp current comprises sensing the lamp current and changing the lamp current if the lamp current differs from the constant RMS value.

3. A method as defined in claim 1, wherein adjusting the lamp current comprises determining lamp power and adjusting the lamp current to the new RMS value if the lamp power reaches the upper power limit.

4. A method as defined in claim 1, wherein adjusting the lamp current comprises sensing the lamp voltage and controlling the lamp current in response to the sensed lamp voltage.

5. A method as defined in claim 1, wherein adjusting the lamp current comprises sensing the lamp voltage and increasing the lamp current to a new RMS value in response to a prescribed value of lamp voltage.

6. A method as defined in claim 1, wherein adjusting the lamp current comprises changing the lamp current in steps.

7. A method as defined in claim 1, wherein adjusting the lamp current comprises changing the lamp current in increments of about 1-2%.

8. A method as defined in claim 1, wherein adjusting the alternating current comprises changing the lamp current continuously from the constant RMS value to the new RMS value.

9. A method as defined in claim 1, wherein adjusting the lamp current comprises changing the lamp current to prevent the power supplied to the lamp from exceeding 120% of the rated power.

10. A method as defined in claim 1, further comprising adjusting the lamp current to a new RMS value to prevent the power supplied to the lamp from decreasing below a lower power limit and maintaining the lamp current constant at the new RMS value.

11. A method as defined in claim 10, wherein the upper power limit and the lower power limit are referenced to the rated power.

12. A method as defined in claim 1, further comprising adjusting the lamp current to a new RMS value to prevent the power supplied to the lamp from decreasing below 80% of the rated power and maintaining the lamp current constant at the new RMS value.

13. A method as defined in claim 1, wherein the discharge lamp includes an arc tube made of quartz and wherein adjusting the lamp current comprises preventing the temperature of the arc tube from exceeding a devitrification point.

14. A lamp system comprising:

a high pressure discharge lamp;

a power circuit for supplying alternating lamp current to the lamp; and a controller configured to control the lamp current at a constant RMS value, to adjust the lamp current to a new RMS value to prevent power supplied to the lamp from exceeding an upper power limit and to maintain the lamp current constant at the new RMS value, wherein the discharge lamp has a rated power and wherein the controller is configured to adjust the lamp current to prevent the power supplied to the lamp from exceeding a specified percentage of the rated power, the controller, after adjusting the lamp current to a new RMS value, implementing a delay on the order of hours before again adjusting the lamp current to a new RMS value.

15. A lamp system as defined in claim 14, wherein the controller comprises a current sensing circuit for sensing the lamp current and a control circuit for controlling the lamp current in response to the sensed lamp current.

16. A lamp system as defined in claim 14, wherein the controller comprises a voltage sensing circuit for sensing the lamp voltage and a control circuit for controlling the lamp current in response to the sensed lamp voltage.

17. A lamp system as defined in claim 14, wherein the controller comprises a voltage sensing circuit for sensing the lamp voltage and a control circuit for increasing the lamp current to a new RMS value in response to a prescribed value of lamp voltage.

18. A lamp system as defined in claim 14, wherein the controller comprises a current sensing circuit for sensing the lamp current, a voltage sensing circuit for sensing the lamp voltage and a control circuit configured to compute lamp power from the sensed lamp current and the sensed lamp voltage, and to adjust lamp current in response to the computed lamp power.

19. A lamp system as defined in claim 14, wherein the controller is configured to adjust the lamp current in steps.

20. A lamp system as defined in claim 14, wherein the controller is configured to adjust the lamp current in increments of about 1-2% of the lamp current.

21. A lamp system as defined in claim 14, wherein the controller is configured to adjust the lamp current continuously from the constant RMS value to the new RMS value.

22. A lamp system as defined in claim 14, wherein the controller is configured to adjust the lamp current to prevent the power supplied to the lamp from exceeding 120% of the rated power.

23. A lamp system as defined in claim 14, wherein the controller is configured to adjust the lamp current to prevent the power supplied to the lamp from decreasing below a lower power limit.

24. A lamp system as defined in claim 14, wherein the controller is configured to adjust the lamp current to prevent the power supplied to the lamp from decreasing below 80% of the rated power.

25. A lamp system as defined in claim 14, wherein the discharge lamp includes an arc tube made of quartz and wherein the controller is configured to adjust the lamp current to prevent the temperature of the arc tube from exceeding a devitrification point.

26. A method for operating a high pressure discharge lamp, comprising:

controlling an alternating lamp current supplied to the lamp at a constant RMS value;

adjusting the lamp current to a new RMS value to maintain lamp power between an upper power limit and a lower power limit and maintaining the lamp current constant at the new RMS value; and after adjusting the lamp current to a new RMS value, implementing a delay on the order of hours before again adjusting the lamp current to a new RMS value.

27. A lamp system comprising:

a high pressure discharge lamp;

a power circuit for supplying alternating lamp current to the lamp; and a controller configured to control the lamp current at a constant RMS value, to adjust the lamp current to a new RMS value to maintain lamp power between an upper power limit and a lower power limit, and to maintain the lamp current constant at the new RMS value, the controller, after adjusting the lamp current to a new RMS value, implementing a delay on the order of hours before again adjusting the lamp current to a new RMS value.

28. A method for operating a high pressure discharge lamp, comprising:

controlling an alternating lamp current supplied to the lamp at a constant RMS value; and increasing the lamp current to a new RMS value in response to a prescribed value of lamp voltage and maintaining the lamp current constant at the new RMS value, wherein the prescribed value of lamp voltage is given by $$V_{lmp2} \cong V_{lmp\ nom} \cdot \tfrac{1}{2} \cdot [P_{lmp\ hi}/P_{lmp\ nom}],$$

where $V_{lmp\ nom}$=nominal lamp voltage, $P_{lmp\ hi}$=upper power limit, and $P_{lmp\ nom}$=nominal lamp power.

29. A method as defined in claim 28, further comprising adjusting the lamp current to a new RMS value to prevent power supplied to the lamp from exceeding an upper power limit and maintaining the lamp current constant at the new RMS value.

30. A lamp system comprising:

a high pressure discharge lamp;

a power circuit for supplying alternating lamp current to the lamp; and a controller configured to control the lamp current at a constant RMS value, to increase the lamp current to a new RMS value in response to a prescribed value of lamp voltage and to maintain the lamp current constant at the new RMS value, wherein the prescribed value of lamp voltage is given by $$V_{lmp2} \cong V_{lmp\ nom} \cdot \tfrac{1}{2} \cdot [P_{lmp\ hi}/P_{lmp\ nom}],$$

where $V_{lmp\ nom}$=nominal lamp voltage, $P_{lmp\ hi}$=upper power limit, and $P_{lmp\ nom}$=nominal lamp power.

31. A lamp system as defined in claim 30, wherein the controller is further configured to adjust the lamp current to a new RMS value to prevent power supplied to the lamp from exceeding an upper power limit and to maintain the lamp current constant at the new RMS value.

32. A method as defined in claim 28, wherein the upper power limit is 120% of rated lamp power.

33. A lamp system as defined in claim 30, wherein the upper power limit is 120% of rated lamp power.

* * * * *